US010178491B2

(12) United States Patent
Faller et al.

(10) Patent No.: US 10,178,491 B2
(45) Date of Patent: Jan. 8, 2019

(54) APPARATUS AND A METHOD FOR MANIPULATING AN INPUT AUDIO SIGNAL

(71) Applicant: Huawei Technologies Co., Ltd., Shenzhen (CN)

(72) Inventors: Christof Faller, Uster (CH); Alexis Favrot, Uster (CH); Liyun Pang, Munich (DE); Peter Grosche, Munich (DE); Yue Lang, Beijing (CN)

(73) Assignee: Huawei Technologies Co., Ltd., Shenzhen (CN)

( * ) Notice: Subject to any disclaimer, the term of this patent is extended or adjusted under 35 U.S.C. 154(b) by 0 days.

(21) Appl. No.: 15/411,859

(22) Filed: Jan. 20, 2017

(65) Prior Publication Data

US 2017/0134877 A1 May 11, 2017

Related U.S. Application Data

(63) Continuation of application No. PCT/EP2014/065728, filed on Jul. 22, 2014.

(51) Int. Cl.

| | |
|---|---|
| ***H04R 3/04*** | (2006.01) |
| ***H04S 7/00*** | (2006.01) |
| ***H04S 3/00*** | (2006.01) |

(52) U.S. Cl.

CPC ..... *H04S 7/302* (2013.01); *H04R 3/04* (2013.01); *H04S 3/008* (2013.01); *H04S 2400/01* (2013.01); *H04S 2400/11* (2013.01); *H04S 2420/01* (2013.01); *H04S 2420/03* (2013.01)

(58) Field of Classification Search

CPC .. H04S 1/007; H04S 2400/11; H04S 2420/01; H04S 2420/07; G10H 2210/265; G10H 2210/301; G10H 2210/305

See application file for complete search history.

(56) References Cited

U.S. PATENT DOCUMENTS

| | | | |
|---|---|---|---|
| 4,817,149 | A | 3/1989 | Myers |
| 5,920,840 | A | 7/1999 | Satyamurti et al. |
| 7,391,877 | B1 | 6/2008 | Brungart |

(Continued)

FOREIGN PATENT DOCUMENTS

| | | | |
|---|---|---|---|
| CN | 1905764 | A | 1/2007 |
| CN | 101123830 | A | 2/2008 |

(Continued)

OTHER PUBLICATIONS

Zolzer, "DAFX: Digital Audio Effects," Second Edition, Helmut Schmidt University, John Wiley & Sons, Ltd (2011).

(Continued)

*Primary Examiner* — Duc Nguyen
*Assistant Examiner* — Kile O Blair
(74) *Attorney, Agent, or Firm* — Leydig, Voit & Mayer, Ltd.

(57) ABSTRACT

The disclosure relates to an apparatus for manipulating an input audio signal associated to a spatial audio source within a spatial audio scenario, wherein the spatial audio source has a certain distance to a listener within the spatial audio scenario. The apparatus comprises an exciter adapted to manipulate the input audio signal to obtain an output audio signal, and a controller adapted to control parameters of the exciter for manipulating the input audio signal based on the certain distance.

19 Claims, 6 Drawing Sheets

(56) References Cited

U.S. PATENT DOCUMENTS

| | | | | |
|---|---|---|---|---|
| 8,346,565 | B2 | 1/2013 | Uhle et al. | |
| 2003/0007648 | A1 | 1/2003 | Currell | |
| 2005/0147261 | A1* | 7/2005 | Yeh | H04M 3/567 381/92 |
| 2007/0019822 | A1 | 1/2007 | Seo et al. | |
| 2008/0130918 | A1 | 6/2008 | Kimijima | |
| 2009/0046864 | A1 | 2/2009 | Mahabub et al. | |
| 2009/0252338 | A1 | 10/2009 | Koppens et al. | |
| 2011/0243336 | A1 | 10/2011 | Nakano et al. | |
| 2013/0314497 | A1 | 11/2013 | Tsuchida | |

FOREIGN PATENT DOCUMENTS

| | | | |
|---|---|---|---|
| EP | 0276159 | A2 | 7/1988 |
| EP | 2234103 | A1 | 9/2010 |
| JP | H03114000 | A | 5/1991 |
| JP | H06269096 | A | 9/1994 |
| JP | 2550380 | B2 | 11/1996 |
| JP | 2010520671 | A | 6/2010 |
| JP | 2013243626 | A | 12/2013 |
| RU | 2454825 | C2 | 6/2012 |
| WO | WO 2008106680 | A2 | 9/2008 |
| WO | 2010086194 | A2 | 8/2010 |
| WO | 2013181172 | A1 | 12/2013 |

OTHER PUBLICATIONS

Favrot et al., "Illusonic Background Technology Description; Virtual Bass," Illusonic GmbH, Uster, Switzerland (Apr. 27, 2012).

* cited by examiner

APPARATUS AND A METHOD FOR MANIPULATING AN INPUT AUDIO SIGNAL

CROSS-REFERENCE TO RELATED APPLICATIONS

This application is a continuation of International Application No. PCT/EP2014/065728, filed on Jul. 22, 2014, the disclosure of which is hereby incorporated by reference in its entirety.

TECHNICAL FIELD

The disclosure relates to the field of audio signal processing, in particular to the field of spatial audio signal processing.

BACKGROUND

The synthesis of spatial audio signals is a major topic in a plurality of applications. For example, in binaural audio synthesis, a spatial audio source can be virtually arranged at a desired position relative to a listener within a spatial audio scenario by processing the audio signal associated to the spatial audio source such that the listener perceives the processed audio signal as being originated from that desired position.

The spatial position of the spatial audio source relative to the listener can be characterized e.g. by a distance between the spatial audio source and the listener, and/or a relative azimuth angle between the spatial audio source and the listener. Common audio signal processing techniques for adapting the audio signal according to different distances and/or azimuth angles are, e.g., based on adapting a loudness level and/or a group delay of the audio signal.

In U. Zölzer, "DAFX: Digital Audio Effects," John Wiley & Sons, 2002, an overview of common audio signal processing techniques is provided.

SUMMARY

It is the object of the disclosure to provide an efficient concept for manipulating an input audio signal within a spatial audio scenario.

This object is achieved by the features of the independent claims. Further embodiments of the disclosure are apparent from the dependent claims, the description and the figures.

The disclosure is based on the finding that the input audio signal can be manipulated by an exciter, wherein control parameters of the exciter can be controlled by a controller in dependence of a certain distance between a spatial audio source and a listener within the spatial audio scenario. The exciter can comprise a band-pass filter for filtering the input audio signal, a non-linear processor for non-linearly processing the filtered audio signal, and a combiner for combining the filtered and non-linearly processed audio signal with the input audio signal. By controlling parameters of the exciter in dependence of the certain distance, complex acoustic effects, such as proximity effects, can be considered.

According to a first aspect, the disclosure relates to an apparatus for manipulating an input audio signal associated to a spatial audio source within a spatial audio scenario, wherein the spatial audio source has a certain distance to a listener within the spatial audio scenario, the apparatus comprising an exciter adapted to manipulate the input audio signal to obtain an output audio signal, and a controller adapted to control parameters of the exciter for manipulating the input audio signal based on the certain distance. Thus, an efficient concept for manipulating the input audio signal within the spatial audio scenario based on a distance to a listener can be realized.

The apparatus facilitates an efficient solution for adapting or manipulating an input audio signal associated to a spatial audio source within a spatial audio scenario for a realistic perception of a distance or of changes of a distance of the spatial audio source to a listener within a spatial audio scenario.

The apparatus can be applied in different application scenarios, e.g. virtual reality, augmented reality, movie soundtrack mixing, and many more. For augmented reality application scenarios, the spatial audio source can be arranged at the certain distance from the listener. In other audio signal processing application scenarios, the input audio signal can be manipulated to enhance a perceived proximity effect of the spatial audio source.

The spatial audio source can relate to a virtual audio source. The spatial audio scenario can relate to a virtual audio scenario. The certain distance can relate to distance information associated to the spatial audio source and can represent a distance of the spatial audio source to the listener within the spatial audio scenario. The listener can be located at a center of the spatial audio scenario. The input audio signal and the output audio signal can be single channel audio signals.

The certain distance can be an absolute distance or a normalized distance, e.g. normalized to a reference distance, e.g. a maximum distance. The apparatus can be adapted to obtain the certain distance from distance measurement devices or modules, external to or integrated into the apparatus, by manual input, e.g. via Man Machine Interfaces like Graphical User Interfaces and/or sliding controls, by processors calculating the certain distance, e.g. based on a desired position or course of positions the spatial audio source shall have (e.g. for augmented and/or virtual reality applications), or any other distance determiner.

In a first implementation form of the apparatus according to the first aspect as such, the exciter comprises a band-pass filter adapted to filter the input audio signal to obtain a filtered audio signal, a non-linear processor adapted to non-linearly process the filtered audio signal to obtain a non-linearly processed audio signal, and a combiner adapted to combine the non-linearly processed audio signal with the input audio signal to obtain the output audio signal. Thus, the exciter can be realized efficiently.

The band-pass filter can comprise a frequency transfer function. The frequency transfer function of the band-pass filter can be determined by filter coefficients. The non-linear processor can be adapted to apply a non-linear processing, e.g. a hard limiting or a soft limiting, on the filtered audio signal. The hard limiting of the filtered audio signal can relate to a hard clipping of the filtered audio signal. The soft limiting of the filtered audio signal can relate to a soft clipping of the filtered audio signal. The combiner can comprise an adder adapted to add the non-linearly processed audio signal to the input audio signal.

In a second implementation form of the apparatus according to the first aspect as such or any preceding implementation form of the first aspect, the controller is adapted to determine a frequency transfer function of the band-pass filter of the exciter upon the basis of the certain distance. The band-pass filter can, for example, be adapted to filter the input audio signal. Thus, excited frequency components of the input audio signal can be determined efficiently.

The controller can be adapted to determine transfer characteristics of the frequency transfer function of the band-pass filter, e.g. a lower cut-off frequency, a higher cut-off frequency, a pass-band attenuation, a stop-band attenuation, a pass-band ripple, and/or a stop-band ripple, upon the basis of the certain distance.

In a third implementation form of the apparatus according to the first aspect as such or any preceding implementation form of the first aspect, the controller is adapted to increase a lower cut-off frequency and/or a higher cut-off frequency of the band-pass filter of the exciter in case the certain distance decreases and vice versa. The band-pass filter can, for example, be adapted to filter the input audio signal. Thus, higher frequency components of the input audio signal can be excited when the certain distance decreases.

The lower cut-off frequency can relate to a −3 dB lower cut-off frequency of a frequency transfer function of the band-pass filter. The higher cut-off frequency can relate to a −3 dB higher cut-off frequency of a frequency transfer function of the band-pass filter.

In a fourth implementation form of the apparatus according to the first aspect as such or any preceding implementation form of the first aspect, the controller is adapted to increase a bandwidth of the band-pass filter of the exciter in case the certain distance decreases and vice versa. The band-pass filter can, for example, be adapted to filter the input audio signal. Thus, more frequency components of the input audio signal can be excited when the certain distance decreases. The bandwidth of the band-pass filter can relate to a −3 dB bandwidth of the band-pass filter.

In a fifth implementation form of the apparatus according to the first aspect as such or any preceding implementation form of the first aspect, the controller is adapted to determine a lower cut-off frequency and/or a higher cut-off frequency of the band-pass filter of the exciter according to the following equations:

$$f_H = (2 - r_{norm}) \cdot b_{1_freq}$$

$$f_L = (2 - r_{norm}) \cdot b_{2_freq}$$

$$r_{norm} = \frac{r}{r_{max}}$$

wherein $f_H$ denotes the higher cut-off frequency, $f_L$ denotes the lower cut-off frequency, $b_{1_freq}$ denotes a first reference cut-off frequency, $b_{2_freq}$ denotes a second reference cut-off frequency, r denotes the certain distance, $r_{max}$ denotes a maximum distance, and $r_{norm}$ denotes a normalized distance. Thus, the lower cut-off frequency and/or the higher cut-off frequency can be determined efficiently. In case the controller increases the lower cut-off frequency and the higher cut-off frequency based on a decreasing certain distance r, the bandwidth of the band-pass filter also increases. In case the controller decreases the lower cut-off frequency and the higher cut-off frequency based on an increasing certain distance r, the bandwidth of the band-pass filter also decreases. The band-pass filter can, for example, be adapted to filter the input audio signal.

The controller according to the fifth implementation form may be adapted to obtain the distance r or, in an alternative implementation form, the normalized distance $r_{norm}$ as the certain distance.

In a sixth implementation form of the apparatus according to the first aspect as such or any preceding implementation form of the first aspect, the controller is adapted to control parameters of the non-linear processor of the exciter for obtaining a non-linearly processed audio signal upon the basis of the certain distance. The non-linear processor can be adapted to obtain the non-linearly processed audio signal based on a filtered version of the input audio signal, e.g. filtered by the band-pass filter. Thus, non-linear effects can be employed for exciting the input audio signal, i.e. to obtain the output audio signal based on the non-linear processed version of the input audio signal or of the filtered input audio signal.

The parameters of the non-linear processor can comprise a limiting threshold value of a hard limiting scheme and/or a further limiting threshold value of a soft limiting scheme.

In a seventh implementation form of the apparatus according to the first aspect as such or any preceding implementation form of the first aspect, the controller is adapted to control parameters of the non-linear processor of the exciter such that a non-linearly processed audio signal comprises more harmonics and/or more power in a high-frequency portion of the non-linearly processed audio signal in case the certain distance decreases and vice versa. Or in other words, the controller is adapted to control parameters of the non-linear processor of the exciter such that the non-linear processor creates harmonic frequency components which are not present in the signal input to the non-linear processor, respectively such that the signal output by the non-linear processor comprises harmonic frequency components which are not present in the signal input to the non-linear processor. Thus, a perceived brightness of the output audio signal can be increased when decreasing the certain distance.

In an eighth implementation form of the apparatus according to the first aspect as such or any preceding implementation form of the first aspect, the non-linear processor of the exciter is adapted to limit a magnitude of a filtered audio signal in time domain to a magnitude less than a limiting threshold value to obtain the non-linearly processed audio signal, and the controller is adapted to control the limiting threshold value upon the basis of the certain distance. Thus, a hard limiting or hard clipping of the filtered audio signal can be realized. The filtered audio signal can be, for example, the input signal filtered by the band-pass filter.

In a ninth implementation form of the apparatus according to the eighth implementation form of the first aspect, the controller is adapted to decrease the limiting threshold value in case the certain distance decreases and vice versa. Thus, non-linear effects can have an increasing influence when the certain distance decreases. In case the certain distance decreases, the limiting threshold value decreases, and more harmonics are generated.

In a tenth implementation form of the apparatus according to the eighth implementation form or the ninth implementation form of the first aspect, the controller is adapted to determine the limiting threshold value upon the basis of the certain distance according to the following equations:

$$lt = LT \cdot r_{norm}$$

$$r_{norm} = \frac{r}{r_{max}}$$

wherein lt denotes the limiting threshold value, LT denotes a limiting threshold constant or limiting threshold reference, r denotes the certain distance, $r_{max}$ denotes a maximum distance, and $r_{norm}$ denotes a normalized distance. Thus, the limiting threshold value can be determined efficiently.

The controller according to the tenth implementation form may be adapted to obtain the distance r or, in an alternative implementation form, the normalized distance $r_{norm}$ as the certain distance.

In an eleventh implementation form of the apparatus according to the first aspect as such or any preceding implementation form of the first aspect, the non-linear processor of the exciter is adapted to multiply the filtered audio signal by a gain signal in time domain, and the gain signal is determined from the input audio signal upon the basis of the certain distance. Thus, a soft limiting or soft clipping of the filtered audio signal can be realized.

The gain signal can be determined from the input audio signal upon the basis of the certain distance by the non-linear processor and/or the controller.

In a twelfth implementation form of the apparatus according to the eleventh implementation form of the first aspect, the controller is adapted to determine the gain signal upon the basis of the certain distance according to the following equations:

$$\mu[n] = \min\left(\frac{s_{rms}[n]}{|s_{BP}[n]| \cdot (1 - lt[n])}, 1\right)$$

$$lt[n] = limthr + (1 - limthr) \cdot r_{norm}[n]$$

$$r_{norm} = \frac{r}{r_{max}}$$

wherein μ denotes the gain signal, $s_{rms}$ denotes a root-mean-square input audio signal, $s_{BP}$ denotes the filtered audio signal, lt denotes a further limiting threshold value, limthr denotes a further limiting threshold constant, r denotes the certain distance, $r_{max}$ denotes a maximum distance, $r_{norm}$ denotes a normalized distance, and n denotes a sample time index. Thus, the gain signal can be determined efficiently. The root-mean-square input audio signal can be determined from the input audio signal by the non-linear processor and/or the controller.

The controller according to the twelfth implementation form may be adapted to obtain the distance r or, in an alternative implementation form, the normalized distance $r_{norm}$ as the certain distance.

In a thirteenth implementation form of the apparatus according to the first aspect as such or any preceding implementation form of the first aspect, the exciter comprises a scaler adapted to weight a non-linearly processed audio signal, e.g. a non-linearly processed version of a filtered version of the input audio signal, by a gain factor, and the controller is adapted to determine the gain factor of the scaler upon the basis of the certain distance. Thus, an influence of non-linear effects can be adapted upon the basis of the certain distance.

The scaler can comprise a multiplier for weighting the non-linearly processed audio signal by the gain factor. The gain factor can be a real number, e.g. ranging from 0 to 1.

In a fourteenth implementation form of the apparatus according to the thirteenth implementation form of the first aspect, the controller is adapted to increase the gain factor in case the certain distance decreases and vice versa. Thus, non-linear effects can have an increasing influence when decreasing the certain distance.

In a fifteenth implementation form of the apparatus according to the thirteenth implementation form or the fourteenth implementation form of the first aspect, the controller is adapted to determine the gain factor upon the basis of the certain distance according to the following equations:

$$g_{exc}[n] = 1 - r_{norm}[n]$$

$$r_{norm} = \frac{r}{r_{max}}$$

wherein $g_{exc}$ denotes the gain factor, r denotes the certain distance, $r_{max}$ denotes a maximum distance, $r_{norm}$ denotes a normalized distance, and n denotes a sample time index. Thus, the gain factor can be determined efficiently and is decreased when the certain distance increases and vice versa.

The controller according to the fifteenth implementation form may be adapted to obtain the distance r or, in an alternative implementation form, the normalized distance $r_{norm}$, as the certain distance.

In a sixteenth implementation form of the apparatus according to the first aspect as such or any preceding implementation form of the first aspect, the apparatus further comprises a determiner adapted to determine the certain distance. Thus, the certain distance can be determined from distance information provided by external signal processing components.

The determiner can determine the certain distance, e.g., from any distance measurement, from spatial coordinates of the spatial audio source and/or from spatial coordinates of the listener within the spatial audio scenario.

The determiner can be adapted to determine the certain distance as an absolute distance or as a normalized distance, e.g. normalized to a reference distance, e.g. a maximum distance. The determiner can be adapted to obtain the certain distance from distance measurement devices or modules, external to or integrated into the apparatus, by manual input, e.g. via Man Machine Interfaces like Graphical User Interfaces and/or sliding controls, by processors calculating the certain distance, e.g. based on a desired position or course of positions the spatial audio source shall have (e.g. for augmented and/or virtual reality applications), or any other distance determiner.

According to a second aspect, the disclosure relates to a method for manipulating an input audio signal associated to a spatial audio source within a spatial audio scenario, wherein the spatial audio source has a certain distance to a listener within the spatial audio scenario, the method comprising controlling exciting parameters by a controller for exciting the input audio signal upon the basis of the certain distance, and exciting the input audio signal by an exciter to obtain an output audio signal. Thus, an efficient concept for manipulating the input audio signal within the spatial audio scenario based on a distance to a listener can be realized.

The method facilitates an efficient solution for adapting or manipulating an input audio signal associated to a spatial audio source within a spatial audio scenario for a realistic perception of a distance or of changes of a distance of the spatial audio source to a listener within a spatial audio scenario.

In a first implementation form of the method according to the second aspect as such, exciting the input audio signal by the exciter comprises band-pass filtering the input audio signal by a band-pass filter to obtain a filtered audio signal, non-linearly processing the filtered audio signal by a non-linear processor to obtain a non-linearly processed audio signal, and combining the non-linearly processed audio signal by a combiner with the input audio signal to obtain the output audio signal. Thus, exciting the input audio signal can be realized efficiently.

In a second implementation form of the method according to the second aspect as such or any preceding implementation form of the second aspect, the method comprises determining a frequency transfer function of the band-pass filter of the exciter upon the basis of the certain distance by the controller. Thus, excited frequency components of the input audio signal can be determined efficiently.

In a third implementation form of the method according to the second aspect as such or any preceding implementation form of the second aspect, the method comprises increasing a lower cut-off frequency and/or a higher cut-off frequency of the band-pass filter of the exciter by the controller in case the certain distance decreases and vice versa. Thus, higher frequency components of the input audio signal can be excited when the certain distance decreases.

In a fourth implementation form of the method according to the second aspect as such or any preceding implementation form of the second aspect, the method comprises increasing a bandwidth of the band-pass filter of the exciter by the controller in case the certain distance decreases and vice versa. Thus, more frequency components of the input audio signal can be excited when the certain distance decreases.

In a fifth implementation form of the method according to the second aspect as such or any preceding implementation form of the second aspect, the method comprises determining a/the lower cut-off frequency and/or the higher cut-off frequency of the band-pass filter of the exciter by the controller according to the following equations:

$$f_H = (2 - r_{norm}) \cdot b_{1_freq}$$

$$f_L = (2 - r_{norm}) \cdot b_{2_freq}$$

$$r_{norm} = \frac{r}{r_{max}}$$

wherein $f_H$ denotes the higher cut-off frequency, $f_L$ denotes the lower cut-off frequency, $b_{1_freq}$ denotes a first reference cut-off frequency, $b_{2_freq}$ denotes a second reference cut-off frequency, r denotes the certain distance, $r_{max}$ denotes a maximum distance, and $r_{norm}$ denotes a normalized distance. Thus, the lower cut-off frequency and/or the higher cut-off frequency can be determined efficiently.

In a sixth implementation form of the method according to the second aspect as such or any preceding implementation form of the second aspect, the method comprises controlling parameters of the non-linear processor of the exciter by the controller for obtaining the non-linearly processed audio signal upon the basis of the certain distance. Thus, non-linear effects can be employed for exciting the input audio signal.

In a seventh implementation form of the method according to the second aspect as such or any preceding implementation form of the second aspect, the method comprises controlling parameters of the non-linear processor of the exciter by the controller such that the non-linearly processed audio signal comprises more harmonics and/or more power in a high-frequency portion of the non-linearly processed audio signal in case the certain distance decreases and vice versa. Or in other words, the method comprises controlling the control parameters of the non-linear processor of the exciter such that harmonic frequency components are created which are not present in the signal input to the non-linear processor, respectively such that the signal output by the non-linear processor comprises harmonic frequency components which are not present in the signal input to the non-linear processor. Thus, a perceived brightness of the output audio signal can be increased when decreasing the certain distance.

In an eighth implementation form of the method according to the second aspect as such or any preceding implementation form of the second aspect, the method comprises limiting a magnitude of a filtered audio signal in time domain to a magnitude less than a limiting threshold value by a/the non-linear processor of the exciter to obtain the non-linearly processed audio signal, and controlling the limiting threshold value by the controller upon the basis of the certain distance. Thus, a hard limiting or hard clipping of the filtered audio signal can be realized.

In a ninth implementation form of the method according to the eighth implementation form of the second aspect, the method comprises decreasing the limiting threshold value by the controller in case the certain distance decreases and vice versa. Thus, non-linear effects can have an increasing influence when the certain distance decreases.

In a tenth implementation form of the method according to the eighth implementation form or the ninth implementation form of the second aspect, the method comprises determining the limiting threshold value by the controller upon the basis of the certain distance according to the following equations:

$$lt = LT \cdot r_{norm}$$

$$r_{norm} = \frac{r}{r_{max}}$$

wherein lt denotes the limiting threshold value, LT denotes a limiting threshold constant or limiting threshold reference, r denotes the certain distance, $r_{max}$ denotes a maximum distance, and $r_{norm}$ denotes a normalized distance. Thus, the limiting threshold value can be determined efficiently.

The method according to the tenth implementation form may comprise obtaining the distance r or, in an alternative implementation form, the normalized distance $r_{norm}$ as the certain distance.

In an eleventh implementation form of the method according to the second aspect as such or any preceding implementation form of the second aspect, the method comprises multiplying the filtered audio signal by a gain signal in time domain by the non-linear processor of the exciter, and determining the gain signal from the input audio signal upon the basis of the certain distance. Thus, a soft limiting or soft clipping of the filtered audio signal can be realized.

In a twelfth implementation form of the method according to the eleventh implementation form of the second aspect, the method comprises determining the gain signal by the controller upon the basis of the certain distance according to the following equations:

$$\mu[n] = \min\left(\frac{s_{rms}[n]}{|s_{BP}[n]| \cdot (1 - lt[n])}, 1\right)$$

$$lt[n] = limthr + (1 - limthr) \cdot r_{norm}[n]$$

-continued $$r_{norm} = \frac{r}{r_{max}}$$

wherein μ denotes the gain signal, $s_{rms}$ denotes a root-mean-square input audio signal, $s_{BP}$ denotes the filtered audio signal, lt denotes a further limiting threshold value, limthr denotes a further limiting threshold constant, r denotes the certain distance, $r_{max}$ denotes a maximum distance, $r_{norm}$ denotes a normalized distance, and n denotes a sample time index. Thus, the gain signal can be determined efficiently.

The method according to the twelfth implementation form may comprise obtaining the distance r or, in an alternative implementation form, the normalized distance $r_{norm}$ as the certain distance.

In a thirteenth implementation form of the method according to the second aspect as such or any preceding implementation form of the second aspect, the method comprises weighting a non-linearly processed audio signal by a scaler of the exciter by a gain factor, and determining the gain factor of the scaler by the controller upon the basis of the certain distance. Thus, an influence of non-linear effects can be adapted upon the basis of the certain distance.

In a fourteenth implementation form of the method according to the thirteenth implementation form of the second aspect, the method comprises increasing the gain factor by the controller in case the certain distance decreases and vice versa. Thus, non-linear effects can have an increasing influence when decreasing the certain distance.

In a fifteenth implementation form of the method according to the thirteenth implementation form or the fourteenth implementation form of the second aspect, the method comprises determining the gain factor by the controller upon the basis of the certain distance according to the following equations:

$$g_{exc}[n] = 1 - r_{norm}[n]$$

$$r_{norm} = \frac{r}{r_{max}}$$

wherein $g_{exc}$ denotes the gain factor, r denotes the certain distance, $r_{max}$ denotes a maximum distance, $r_{norm}$ denotes a normalized distance, and n denotes a sample time index. Thus, the gain factor can be determined efficiently.

The method according to the fifteenth implementation form may comprise obtaining the distance r or, in an alternative implementation form, the normalized distance $r_{norm}$ as the certain distance.

In a sixteenth implementation form of the method according to the second aspect as such or any preceding implementation form of the second aspect, the method further comprises determining the certain distance by a determiner of the apparatus. Thus, the certain distance can be determined from distance information provided by external signal processing components.

The method can be performed by the apparatus. Further features of the method directly result from the functionality of the apparatus.

The explanations provided for the first aspect and its implementation forms apply equally to the second aspect and the corresponding implementation forms.

According to a third aspect, the disclosure relates to a computer program comprising a program code for performing the method according to the second aspect or any of its implementation forms when executed on a computer. Thus, the method can be performed in an automatic and repeatable manner.

The computer program can be performed by the apparatus. The apparatus can be programmably-arranged to perform the computer program.

The disclosure can be implemented in hardware, software or in any combination thereof.

BRIEF DESCRIPTION OF THE DRAWINGS

Further embodiments of the disclosure will be described with respect to the following figures, in which.

Identical reference signs are used for identical or at least equivalent features.

DETAILED DESCRIPTION

Figure 1:
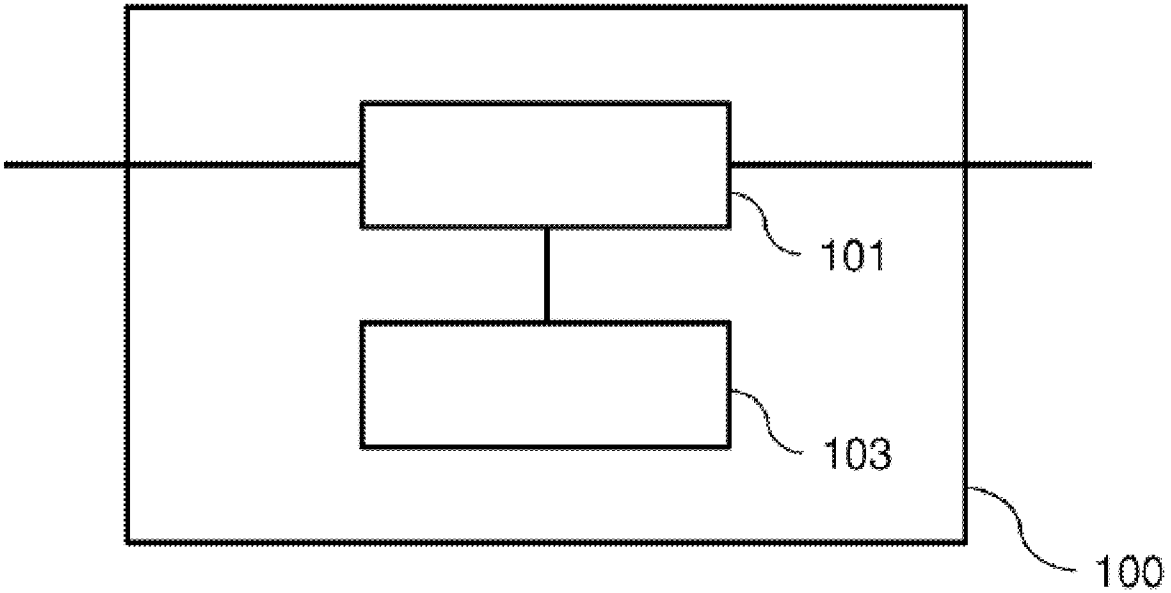
FIG. 1 shows a diagram of an apparatus for manipulating an input audio signal associated to a spatial audio source within a spatial audio scenario according to an implementation form.

FIG. 1 shows a diagram of an apparatus 100 for manipulating an input audio signal associated to a spatial audio source within a spatial audio scenario according to an embodiment of the disclosure. The spatial audio source has a certain distance to a listener within the spatial audio scenario.

The apparatus 100 comprises an exciter 101 adapted to manipulate the input audio signal to obtain an output audio signal, and a controller 103 adapted to control parameters of the exciter for manipulating the input audio signal upon the basis of the certain distance.

The apparatus 100 can be applied in different application scenarios, e.g. virtual reality, augmented reality, movie soundtrack mixing, and many more.

For augmented reality application scenarios, in which typically an additional spatial audio source is added to an existing spatial audio scenario, this additional spatial audio source can be arranged at the certain distance from the listener. In audio signal processing application scenarios, the input audio signal can be manipulated to enhance a perceived proximity effect of the spatial audio source.

The exciter 101 can comprise a band-pass filter adapted to filter the input audio signal to obtain a filtered audio signal, a non-linear processor adapted to non-linearly process the filtered audio signal to obtain a non-linearly processed audio signal, and a combiner adapted to combine the non-linearly processed audio signal with the input audio signal to obtain the output audio signal. The exciter 101 can further comprise a scaler adapted to weight the non-linearly processed audio signal by a gain factor.

The controller 103 is configured to control parameters of the band-pass filter, the non-linear processor, the combiner, and/or the scaler for manipulating the input audio signal upon the basis of the certain distance.

Further details of embodiments of the apparatus 100 are described based on FIGS. 3 to 6.

Figure 2:
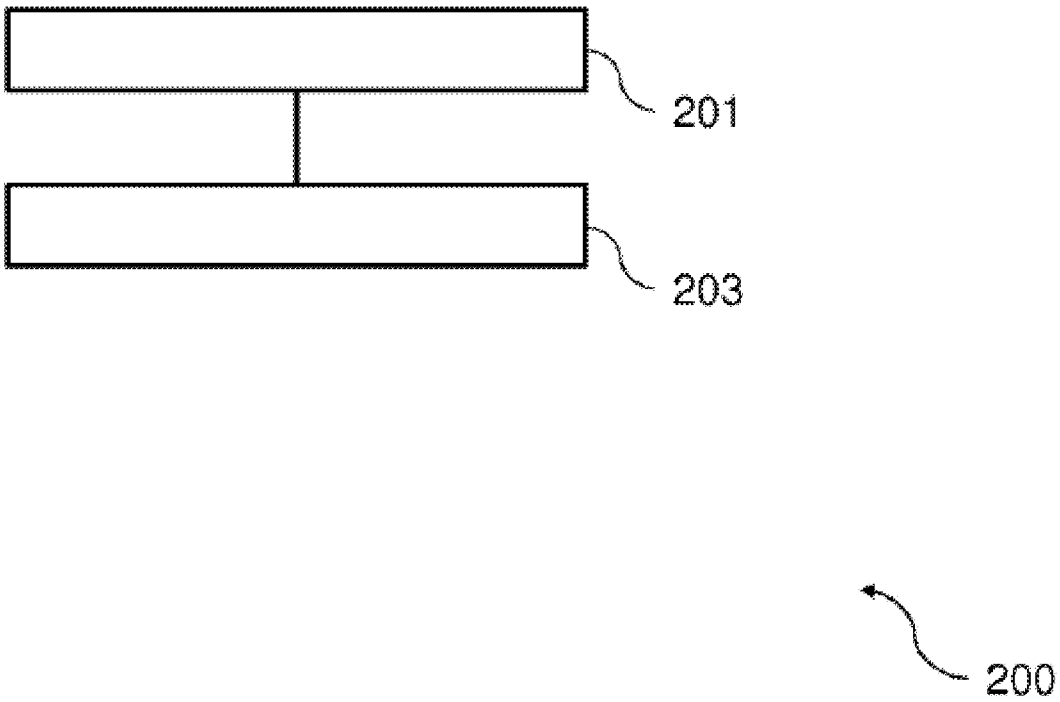
FIG. 2 shows a diagram of a method for manipulating an input audio signal associated to a spatial audio source within a spatial audio scenario according to an implementation form.

FIG. 2 shows a diagram of a method 200 for manipulating an input audio signal associated to a spatial audio source within a spatial audio scenario according to an embodiment of the disclosure. The spatial audio source has a certain distance to a listener within the spatial audio scenario.

The method 200 comprises controlling 201 exciting parameters for exciting the input audio signal upon the basis of the certain distance, and exciting 203 the input audio signal to obtain an output audio signal.

Exciting 203 the input audio signal can comprise band-pass filtering the input audio signal to obtain a filtered audio signal, non-linearly processing the filtered audio signal to obtain a non-linearly processed audio signal, and combining the non-linearly processed audio signal with the input audio signal to obtain the output audio signal.

The method 200 can be performed by the apparatus 100. The controlling step 201 can for example be performed by the controller 103, and the exciting step 203 can for example be performed by the exciter 101. Further features of the method 200 directly result from the functionality of the apparatus 100. The method 200 can be performed by a computer program.

Figure 3:
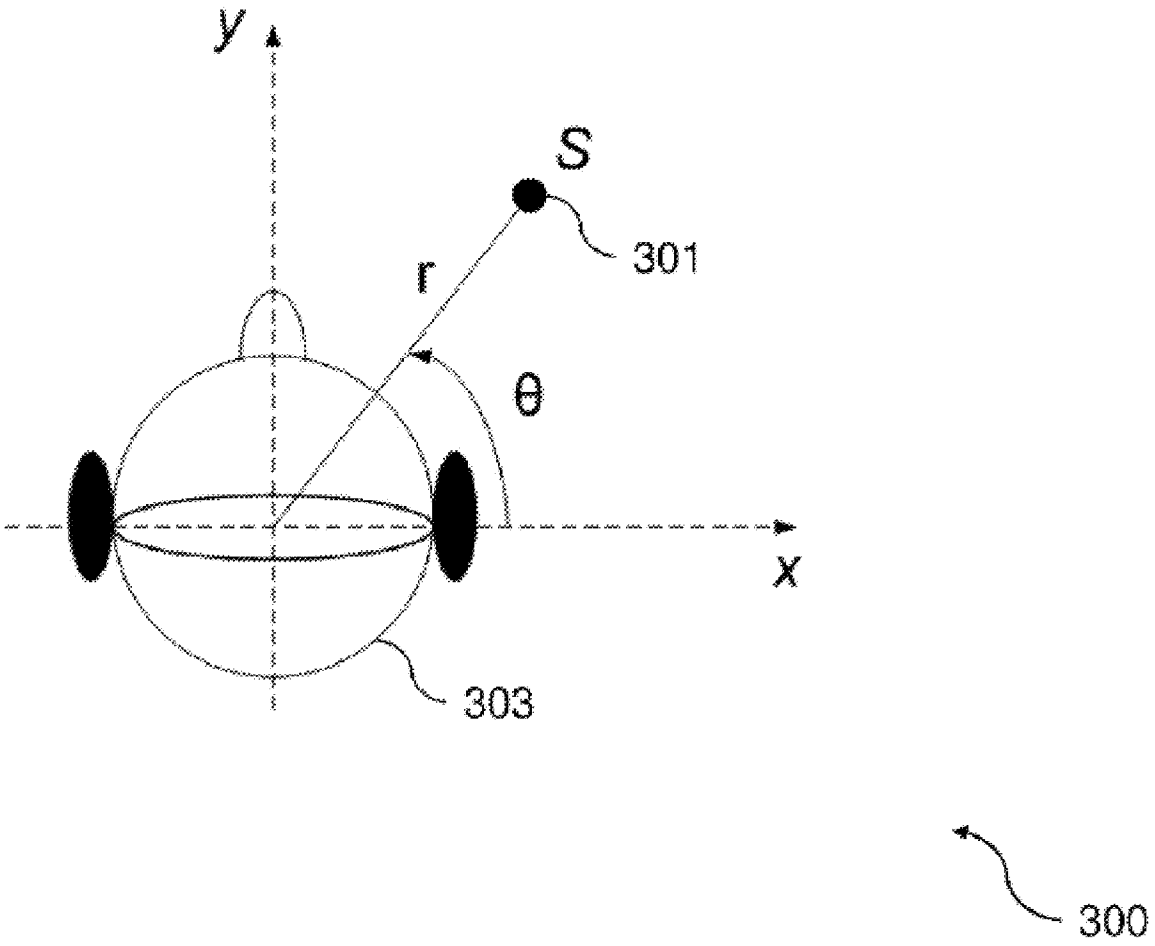
FIG. 3 shows a diagram of a spatial audio scenario with a spatial audio source and a listener according to an implementation form.

FIG. 3 shows a diagram of a spatial audio scenario 300 with a spatial audio source 301 and a listener 303 (depicted is the head of the listener) according to an embodiment of the disclosure. The diagram depicts the spatial audio source 301 as a point sound audio source S in an X-Y plane having a certain distance r and an azimuth Θ relative to a head position of the listener 303 with a look direction along the Y axis.

The perception of proximity of the spatial audio source 301 can be relevant to the listener 303 for a better audio immersion. Audio mixing techniques, in particular binaural audio synthesis techniques, can use audio source distance information for a realistic audio rendering leading to an enhanced audio experience for the listener 303. Moving sound audio sources, e.g. in movies and/or games, can be binaurally mixed using their certain distance r relative to the listener 303.

Proximity effects can be classified as a function of a spatial audio source distance as follows. At small distances up to 1 m, a predominant proximity effect can result from binaural near field effects. As a consequence, the closer the spatial audio source 301 gets, the lower frequencies can be emphasized or boosted. At middle distances from 1 m to 10 m, a predominant proximity effect can result from reverberation. In this distance interval, when the spatial audio source 301 is getting closer, the higher frequencies can be emphasized or boosted. At large distances from 10 m, a predominant proximity effect can be absorption which can result in an attenuation of high frequencies.

The perceived timbre of a sound of the spatial audio source 301 or the point sound audio source S can change with its certain distance r and angle Θ to the listener 303. Θ and r can be used for binaural mixing which can be, for example, performed before the proximity effect processing using the exciter 101.

Embodiments of the apparatus 100 can be used for enhancing or emphasizing a perception of proximity of the virtual or spatial audio source 301 using the exciter 101.

The apparatus 100 can emphasize a proximity effect of a binaural audio output for a more realistic audio rendering. The apparatus can e.g. be applied in a mixing device or any other pre-processing or processing device used for generating or manipulating a spatial audio scenario, but also in other devices, for example mobile devices, e.g. smartphones or tablets, with or without headphones.

Input audio signals, e.g. for movies, can be mixed with moving audio sources by binaural synthesis. A virtual or spatial audio source 301 can be binaurally synthesized by the apparatus 100 with variable distance information.

The apparatus 100 is adapted to adapt the exciter parameters such that when the certain distance r of the spatial audio source 301 varies, the perceived brightness, e.g. a density of high frequencies, is changed accordingly. Thus, embodiments of the apparatus 100 are adapted to modify the brightness of the sound of the virtual or spatial audio source 301 to emphasize the perception of proximity.

In embodiments of the disclosure, a virtual or spatial audio source 301 can be rendered by using an exciter 101 to emphasize the perceptual proximity effect. The exciter can be controlled by the controller 103 to emphasize a frequency portion in order to increase the brightness as a function of the certain distance. As the exciter effect is chosen to be stronger, the spatial audio source 301 is perceived to get closer to the listener 303. The exciter can be adapted as a function of the certain distance of the spatial audio source 301 to the position of the listener 303.

Figure 4:
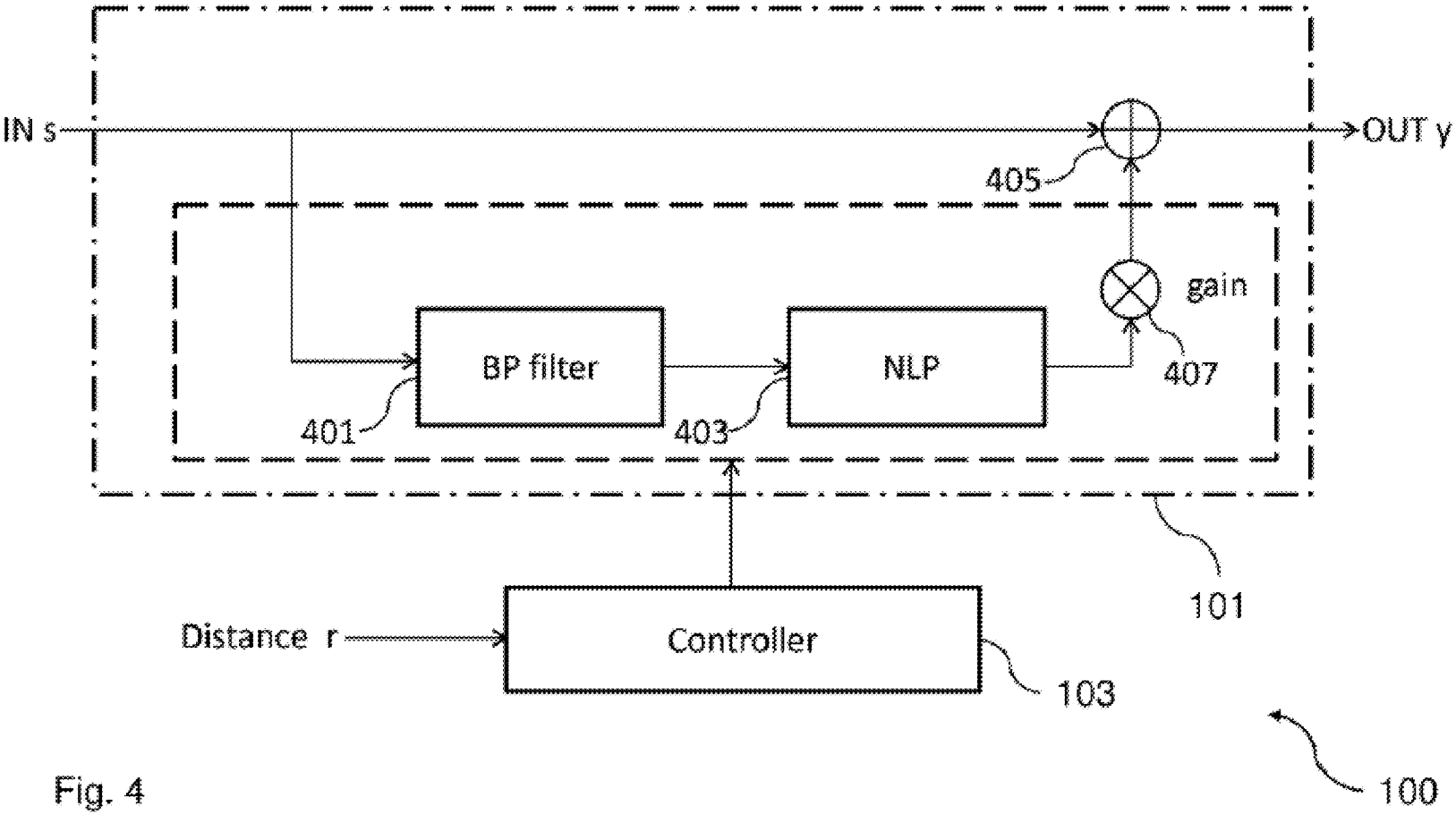
FIG. 4 shows a diagram of an apparatus for manipulating an input audio signal associated to a spatial audio source within a spatial audio scenario according to an implementation form.

FIG. 4 shows a more detailed diagram of an apparatus 100 for manipulating an input audio signal associated to a spatial audio source within a spatial audio scenario according to an embodiment of the disclosure.

The apparatus 100 comprises an exciter 101 and a controller 103. The exciter 101 comprises a band-pass filter (BP filter) 401, a non-linear processor (NLP) 403, a combiner 405 being formed by an adder, and an optional scaler 407 (gain) having a gain factor. The input audio signal is denoted as IN respectively s. The output audio signal is denoted by OUT respectively y. The controller 103 is adapted to receive the certain distance r or distance information related to the certain distance and is further adapted to control the parameters of the exciter 101 based on the certain distance r. In other words, the controller is adapted to control the parameters of the band-pass filter 401, the non-linear processor 403, and the scaler 407 of the exciter 101 based on the certain distance r.

The diagram shows an implementation of the exciter 101 with the band-pass filter 401 and the non-linear processor 403 to generate harmonics in a desired frequency portion. The exciter 101 can realize an audio signal processing technique used to enhance the input audio signal. The exciter 101 can add harmonics, i.e. multiples of a given frequency or a frequency range, to the input audio signal. The exciter 101 can use non-linear processing and filtering to generate the harmonics from the input audio signal, which can be added in order to increase the brightness of the input audio signal.

An embodiment of the apparatus 100 comprising the controller 103 and the exciter 101 is presented in the following. The input audio signal s is firstly filtered using the band-pass filter 401 having an impulse response $f_{BP}$ to extract the frequencies which shall be excited.

$$s_{BP}=f_{BP}*s$$

In order to perceptually match the brightness of the spatial audio source to the certain distance r, the controller is adapted to adjust or set the upper cut-off frequency $f_H$ and the lower cut-off frequency $f_L$ of the band-pass filter 401 as a function of the certain distance of the spatial audio source. These determine the frequency range over which the effect of the exciter 101 is applied.

As the spatial audio source is getting closer, the cut-off frequencies $f_L$ and $f_H$ of the band-pass filter 401 are shifted towards higher frequencies by the controller 103. Optionally, not only the cut-off frequencies $f_L$ and $f_H$ of the band-pass filter 401 are increased with decreasing certain distance r but also the bandwidth, i.e. the difference between $f_H$ and $f_L$ of the band-pass filter 401 is also increased by the controller 103. By increasing the cut-off frequencies, harmonics are generated in higher frequency portions by the non-linear processor 403. By increasing the bandwidth of the band-pass filter 401, the amount of harmonics generated by the non-linear processor 403 are increased.

As a result, the output audio signal has more energy in higher frequency portions and the listener has a perception of an increased brightness when the spatial audio source approaches. For example, $f_H$ and $f_L$ can be defined by the controller 103 according to:

$$F_H=(2-r_{norm})\cdot b_{1_freq}$$

$$F_L=(2-r_{norm})\cdot b_{2_freq}$$

wherein $r_{norm}$ can be a normalized distance, e.g. between 0 and 1, defined as:

$$r_{norm}=\frac{r}{r_{max}}$$

wherein $r_{max}$ can be a maximum possible value of the certain distance r applied to the exciter 101, for example, $r_{max}$=10 meters. $b_{1_freq}$ and $b_{2_freq}$ can be reference cut-off frequencies for the band-pass filter 401, which can form cut-off frequencies of the band-pass filter 401 for the maximum distance $r_{max}$. The controller 103 can be adapted to set or use the reference cut-off frequencies, e.g. $b_{1_freq}$=10 kHz and $b_{2_freq}$=1 kHz.

Then, the non-linear processor 403 is applied on the filtered audio signal $s_{BP}$ to generate harmonics for these frequencies. One example is using a hard limiting scheme relative to a limiting threshold value lt, defined as:

$$s'_{BP}[n]=\begin{cases} lt & \text{if } s_{BP}[n]>lt \\ -lt & \text{if } s_{BP}[n]<-lt \\ s_{BP}[n] & otherweise \end{cases}$$

wherein n is a sample time index and the limiting threshold value lt is controlled as a function of the certain distance r of the spatial audio source. For example, lt can be defined as:

$$lt=LT\cdot r_{norm}$$

wherein LT can be a limiting threshold constant. For example, LT=$10^{-30/20}$, i.e. −30 dB on a linear scale. The closer the spatial audio source is approaching, the smaller the limiting threshold value lt is chosen by the controller in order to generate more harmonics. An audio signal with more harmonics contains more power or energy at higher frequency portions. Therefore, the output audio signal sounds brighter.

Another example is using an adaptive soft clipping or limiting scheme which can have the advantage to follow a magnitude or a level of the input audio signal and can reduce distortions in the resulting signal $s'_{BP}$. The threshold of the limiter can be dynamically determined by the controller 103 based on a root-mean-square (RMS) estimate of the input audio signal, for example according to:

$$s_{rms}[n]=\begin{cases} (1-\alpha_{tt})\cdot s_{rms}[n-1]+\alpha_{tt}\cdot|s_{BP}[n]| & \text{if } |s_{BP}[n]|\geq s_{rms}[n-1] \\ (1-\alpha_{rel})\cdot s_{rms}[n-1]+\alpha_{rel}\cdot|s_{BP}[n]| & \text{otherwise} \end{cases}$$

wherein $\alpha_{tt}$ and $\alpha_{rel}$ respectively are an attack and a release smoothing constant, e.g. having values between 0 and 1, for the RMS estimate. For example, $\alpha_{tt}$=0.0023 and $\alpha_{rel}$=0.0011 can be chosen. Then, $s_{rms}$[n] can be used to derive the limiter threshold according to:

$$\mu[n]=\min\left(\frac{s_{rms}[n]}{|s_{BP}[n]|\cdot(1-lt[n])},1\right)$$

wherein lt[n] can be an adaptive further limiting threshold value to adjust the effect of the limiter depending on the certain distance r. For example, lt[n] can be defined as:

$$lt[n]=\text{limthr}+(1-\text{limthr})\cdot r_{norm}[n]$$

wherein limthr is a further limiting threshold constant having a value between 0 and 1, for example limthr=0.4. Furthermore, the gain signal μ or μ' can be smoothed over time to avoid artifacts due to fast changing values. For example:

$$\mu'[n]=(1-\alpha_{hold})\cdot\mu'[n-1]+\alpha_{hold}\cdot\mu[n]$$

wherein $\alpha_{hold}$ is a hold smoothing constant between 0 and 1, for example $\alpha_{hold}$=0.2.

The output signal of the non-linear processor 403 can be computed as:

$$S'_{BP}[n]=\mu'[n]\cdot s_{BP}[n]$$

The resulting non-linearly processed audio signal is then added to the input audio signal by the combiner 405. The scaler 407 with the gain factor can be used to control the strength of the exciter 101 to generate the output audio signal y according to:

$$y[n]=g_{exc}[n]\cdot S'_{BP}[n]+S[n]$$

The proximity effect can be rendered by controlling the gain factor $g_{exc}$, e.g. with values between 0 and 1, by the controller as a function of the certain distance r of the spatial audio source, meaning that a binaural audio signal can be fed into the exciter 101 whose gain factor can be adapted as a function of the certain distance r of the spatial audio source to reproduce. For example:

$$g_{exc}[n]=1-r_{norm}[n]$$

Embodiments of the apparatus 100 may be adapted to obtain or use the distance r or, in an alternative implementation form, the normalized distance rnorm as the certain distance.

Figure 5:
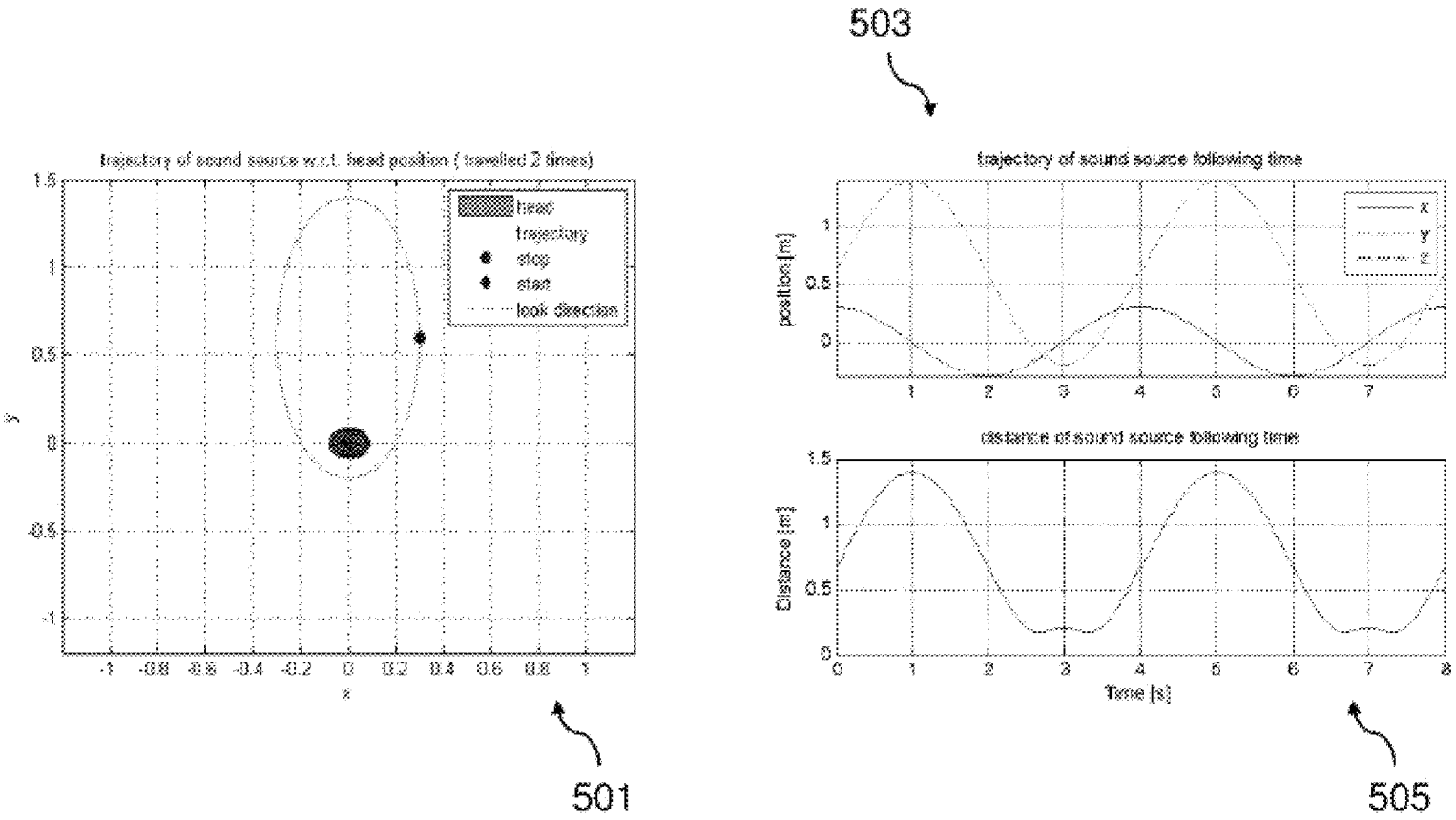
FIG. 5 shows diagrams of arrangements of a spatial audio source around a listener according to an implementation form.

FIG. 5 shows diagrams 501, 503, 505 of arrangements of a spatial audio source around a listener according to an embodiment of the disclosure.

The diagram 501 depicts a trajectory of a spatial audio source around a head of the listener over time. The trajectory travels two times within a Cartesian coordinate X-Y plane.

The diagram 501 shows the trajectory, the head of the listener (at the center of the Cartesian coordinate X-Y plane), a look direction of the listener along the positive X-axis of the X-Y plane, a start position of the trajectory, and a stop position of the trajectory. The diagram 503 depicts an X-position, a Y-position, and a Z-position (no change over time) of the trajectory over time. The diagram 505 depicts the certain distance between the spatial audio source and the listener over time.

The spatial audio source can be considered to move around the head of the listener on an elliptic trajectory with no change in the Z-plane. A time evolution of a moving path in Cartesian X-Y-Z coordinates and a time evolution of the certain distance of the spatial audio source can be considered.

Figure 6:
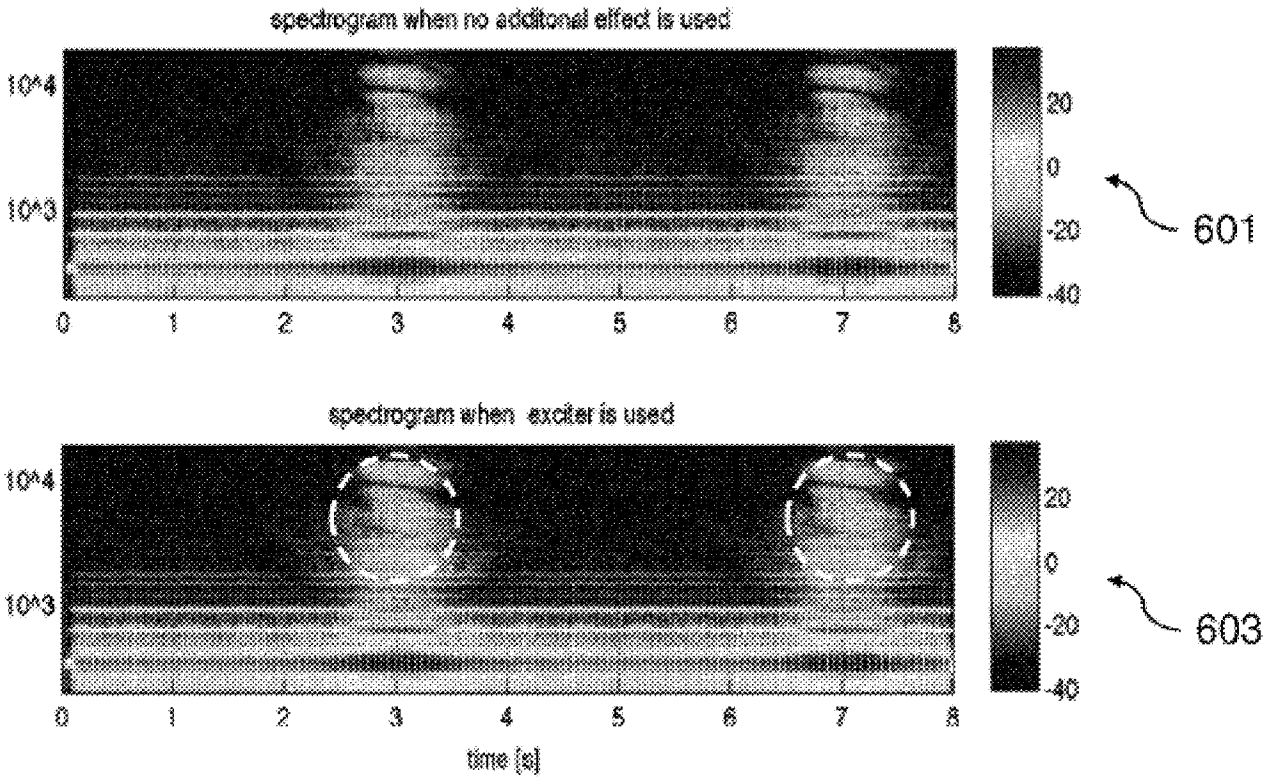
FIG. 6 shows spectrograms of an input audio signal and an output audio signal according to an implementation form.

FIG. 6 shows spectrograms 601, 603 of an input audio signal and an output audio signal according to an embodiment of the disclosure. For illustration, the spectrograms 601, 603 of a right channel, i.e. where the spatial audio source comes closer to the head of the listener, of a binaural output signal are presented.

The spectrograms 601, 603 depict a magnitude of frequency components over time in a grey-scale manner. The spectrogram 601 relates to the input audio signal when no additional exciter is used. The spectrogram 603 relates to the output audio signal when an exciter is used. The input audio signal can e.g. be a right channel or a left channel of a binaural output signal.

In comparison, the excited output audio signal exhibits a higher brightness than the input audio signal without using the exciter.

The increase of the brightness is visualized as a higher density of higher frequencies in the excited output audio signal which is marked by dashed circles.

Several advantages can be achieved by the disclosure. For example, the clarity of a proximate spatial audio source can be emphasized, such that a listener can perceive the spatial audio source as being close. Furthermore, frequencies corresponding to harmonics of the original input audio signal may be increased dynamically. Moreover, high frequencies are not emphasized or boosted excessively. A naturally sounding brightness can be added to the input audio signal without a major change in timbre and colour.

In addition, if the original input audio signal lacks high frequency components, the exciter can be an efficient solution to add brightness to the input audio signal. Furthermore, rendering of spatial audio sources near the listener, rendering of moving spatial audio sources, and/or rendering of object based spatial audio sources can be improved.

In the following further embodiments of the disclosure are described with regard to some exemplary application scenarios.

In a simple case, the spatial audio source is for example a talking person and the audio signal associated to the spatial audio source is a mono audio channel signal, e.g. obtained by recording with a microphone. The controller obtains the certain distance and controls or sets the control parameters of the exciter accordingly. The exciter is adapted to receive the mono audio channel signal as input audio signal IN and to manipulate the audio mono channel signal according to the control parameters to obtain the output audio signal OUT, a mono audio channel signal with a manipulated or adapted perceived distance to the listener.

In one embodiment, this output audio signal forms the spatial audio scenario, i.e. a single audio source spatial audio scenario represented by a mono audio channel signal.

In another embodiment, this output audio channel signal may be further processed by applying a Head Related Transfer Function (HRTF) to obtain from this manipulated mono audio channel signal a binaural audio signal comprising a binaural left and a right channel audio signal. The HRTF may be used to add a desired azimuth angle to the perceived location of the spatial audio source within the spatial audio scenario.

In an alternative embodiment, the HRTF is first applied to the mono audio channel signal, and afterwards the distance manipulation by using the exciter is applied to both, left and right binaural audio channel signals in the same manner, i.e. using the same exciter control parameters.

In even further embodiments, the mono audio channel signal associated to the spatial audio source may be used to obtain instead of a binaural audio signal other audio signal formats comprising directional spatial cues, e.g. stereo audio signals or in general multi-channel signals comprising two or more audio channel signals or their down-mixed audio channel signals and the corresponding spatial parameters. In any of these embodiments, like for the binaural embodiments, the manipulation of the mono audio channel signal by the exciter may be performed before the directivity manipulation or afterwards, in the latter case typically the same exciter parameters are applied to all of the audio channel signals of the multi-channel audio signal individually.

In certain embodiments, e.g. for augmented reality applications or movie sound track mixing, these mono, binaural or multi-channel representations of the audio channel signal associated to the spatial audio source may be mixed with an existing mono, binaural or multi-channel representation of a spatial audio scenario already comprising one or more spatial audio sources.

In other embodiments, e.g. for virtual reality applications or movie sound track mixing, these mono, binaural or multi-channel representations of the audio channel signal associated to the spatial audio source may be mixed with a mono, binaural or multi-channel representation of other spatial audio sources to create a spatial audio scenario comprising two or more spatial audio sources.

In even further embodiments, in particular for spatial audio scenarios represented by binaural or multi-channel audio signals comprising two or more spatial audio sources, source separation may be performed to separate one spatial audio source from the other spatial audio sources, and to perform the perceived distance manipulation using, e.g., embodiments 100 or 200 of the disclosure to manipulate the perceived distance of this one spatial audio signal respectively spatial audio source compared to the other spatial audio sources also comprised in the spatial audio scenario. Afterwards the manipulated separated audio channel signal is mixed to the spatial audio scenario represented by binaural or multi-channel audio signals.

In even other embodiments some or all spatial audio signals are separated to manipulate the perceived distance of these some or all spatial audio signals respectively spatial audio sources. Afterwards the manipulated separated audio channel signals are mixed to form the manipulated spatial audio scenario represented by binaural or multi-channel audio signals. In case the perceived distance of all spatial audio sources comprised in the spatial audio scenario shall be manipulated, the source separation may also be omitted and the distance manipulation using embodiments 100 and 200 of the disclosure may be equally applied to the individual audio channel signals of the binaural or multi-channel signal.

The spatial audio source may be or may represent a human, an animal, a music instrument or any other source which may be considered to generate the associated spatial audio signal. The audio channel signal associated to the spatial audio source may be a natural or recorded audio signal or an artificially generated audio signal or a combination of the aforementioned audio signals.

The embodiments of the disclosure can relate to an apparatus and/or a method to render a spatial audio source through headphones of a listener, comprising an exciter to excite the input audio signal, and comprising a controller to adjust parameters of the exciter as a function of the corresponding certain distance.

The exciter can apply a filter to its input audio signal based on distance information. The exciter can apply a non-linearity to the filtered audio signal based on the distance information. The exciter can further apply a scaling by a gain factor to control the strength of the exciter based on the distance information. The resulting audio signal can be added to the input audio signal to provide the output audio signal.

What is claimed is:

1. An apparatus for manipulating an input audio signal, the apparatus comprising:

an exciter adapted to manipulate the input audio signal to obtain an output audio signal, wherein the input audio signal is associated with a spatial audio source, and the spatial audio source is separated from a listener by a first distance, wherein a non-linear processor of the exciter is adapted to limit a magnitude of a filtered audio signal in time domain to a magnitude less than a limiting threshold value to obtain a non-linearly processed audio signal; and a controller adapted to control parameters of the exciter for manipulating the input audio signal based on the first distance, wherein the controller is adapted to control the limiting threshold value based on the first distance.

2. The apparatus of claim 1, wherein the exciter comprises:

a band-pass filter adapted to filter the input audio signal to obtain a filtered audio signal;

a non-linear processor adapted to non-linearly process the filtered audio signal to obtain a non-linearly processed audio signal; and a combiner adapted to combine the non-linearly processed audio signal with the input audio signal to obtain the output audio signal.

3. The apparatus of claim 1, wherein the controller is adapted to determine a frequency transfer function of a band-pass filter of the exciter based on the first distance.

4. The apparatus of claim 1, wherein the controller is adapted to:

increase at least one of a lower cut-off frequency and a higher cut-off frequency of a band-pass filter of the exciter based on a decrease in the first distance, and decrease at least one of the lower cut-off frequency and the higher cut-off frequency of the band-pass filter of the exciter based on an increase in the first distance.

5. The apparatus of claim 1, wherein the controller is adapted to:

increase a bandwidth of a band-pass filter of the exciter based on a decrease in the first distance, and decrease the bandwidth of the band-pass filter of the exciter based on an increase in the first distance.

6. The apparatus of claim 1, wherein the controller is adapted to determine at least one of a lower cut-off frequency and a higher cut-off frequency of a band-pass filter of the exciter according to the following equations:

$$f_H = (2 - r_{norm}) \cdot b_{1_freq}$$

$$f_L = (2 - r_{norm}) \cdot b_{2_freq}$$

$$r_{norm} = \frac{r}{r_{max}}$$

wherein $f_H$ denotes the higher cut-off frequency, $f_L$ denotes the lower cut-off frequency, $b_{1_{13}\,freq}$ denotes a first reference cut-off frequency, $b_{2_freq}$ denotes a second reference cut-off frequency, r denotes the first distance, $r_{max}$ denotes a maximum distance, and $r_{norm}$ denotes a normalized distance.

7. The apparatus of claim 1, wherein the controller is adapted to control parameters of a non-linear processor of the exciter for obtaining a non-linearly processed audio signal based on the first distance.

8. The apparatus of claim 1, wherein the controller is adapted to control parameters of a non-linear processor of the exciter, such that a non-linearly processed audio signal comprises:

at least one of more harmonics and more power in a high-frequency portion of the non-linearly processed audio signal in case of a decrease in the first distance, and at least one of less harmonics and less power in the high-frequency portion of the non-linearly processed audio signal in case of an increase in the first distance.

9. The apparatus of claim 1, wherein the controller is adapted to:

decrease the limiting threshold value based on a decrease in the first distance, and increase the limiting threshold value based on an increase in the first distance.

10. The apparatus of claim 1, wherein the controller is adapted to determine the limiting threshold value according to the following equations:

$$lt = LT \cdot r_{norm}$$

$$r_{norm} = \frac{r}{r_{max}}$$

wherein lt denotes the limiting threshold value, LT denotes a limiting threshold constant, r denotes the first distance, $r_{max}$ denotes a maximum distance, and $r_{norm}$ denotes a normalized distance.

11. The apparatus of claim 1, wherein a non-linear processor of the exciter is adapted to multiply a filtered audio signal by a gain signal in time domain, and wherein the gain signal is determined from the input audio signal based on the first distance.

12. The apparatus of claim 11, wherein the controller is adapted to determine the gain signal based on the first distance according to the following equations:

$$\mu[n] = \min\left(\frac{s_{rms}[n]}{|s_{BP}[n]| \cdot (1 - lt[n])}, 1\right)$$

$$lt[n] = limthr + (1 - limthr) \cdot r_{norm}[n]$$

-continued $$r_{norm} = \frac{r}{r_{max}}$$

wherein μ denotes the gain signal, $s_{rms}$ denotes a root-mean-square input audio signal, $S_{Bp}$ denotes the filtered audio signal, lt denotes a further limiting threshold value, limthr denotes a further limiting threshold constant, r denotes the first distance, $r_{max}$ denotes a maximum distance, $r_{norm}$ denotes a normalized distance, and n denotes a sample time index.

13. The apparatus of claim 1, wherein the exciter comprises a scaler adapted to weight a non-linearly processed audio signal by a gain factor, and wherein the controller is adapted to determine the gain factor of the scaler based on the first distance.

14. The apparatus of claim 13, wherein the controller is adapted to:

increase the gain factor in case of a decrease in the first distance, and decrease the gain factor in case of an increase in the first distance.

15. The apparatus of claim 13, wherein the controller is adapted to determine the gain factor based on first distance according to the following equations:

$$g_{exc}[n] = 1 - r_{norm}[n]$$

$$r_{norm} = \frac{r}{r_{max}}$$

wherein $g_{exc}$ denotes the gain factor, r denotes the first distance, $r_{max}$ denotes a maximum distance, $r_{norm}$ denotes a normalized distance, and n denotes a sample time index.

16. The apparatus of claim 1, wherein the apparatus is adapted to determine the first distance.

17. A method for manipulating an input audio signal, the method comprising:

controlling exciting parameters for exciting the input audio signal, wherein the input audio signal is associated with a spatial audio source, and wherein a first distance separates the spatial audio source and a listener; and exciting the input audio signal to obtain an output audio signal, wherein exciting the input audio signal comprises multiplying a filtered audio signal by a gain signal in time domain, wherein the gain signal is determined from the input audio signal based on the first distance according to the following equations:

$$\mu[n] = \min\left(\frac{s_{rms}[n]}{|s_{BP}[n]| \cdot (1 - lt[n])}, 1\right)$$

$$lt[n] = limthr + (1 - limthr) \cdot r_{norm}[n]$$

$$r_{norm} = \frac{r}{r_{max}}$$

wherein μ denotes the gain signal, $s_{rms}$ denotes a root-mean-square input audio signal, $s_{Bp}$ denotes the filtered audio signal, lt denotes a further limiting threshold value, limthr denotes a further limiting threshold constant, r denotes the first distance, $r_{max}$ denotes a maximum distance, $r_{norm}$ denotes a normalized distance, and n denotes a sample time index.

18. The method of claim 17, wherein exciting the input audio signal comprises:

band-pass filtering the input audio signal to obtain a filtered audio signal;

non-linearly processing the filtered audio signal to obtain a non-linearly processed audio signal; and combining the non-linearly processed audio signal with the input audio signal to obtain the output audio signal.

19. A non-transitory computer readable medium storing a program code that, when executed, cause a processor to manipulate an input audio signal by performing the steps of:

controlling exciting parameters for exciting the input audio signal, wherein the input audio signal is associated with a spatial audio source, and wherein a first distance separates the spatial audio source and a listener; and exciting the input audio signal to obtain an output audio signal, wherein exciting the input audio signal is based on a band-pass filter, wherein at least one of a lower cut-off frequency and a higher cut-off frequency of the band-pass filter is based on the following equations:

$$f_H = (2 - r_{norm}) \cdot b_{1_freq}$$

$$f_L = (2 - r_{norm}) \cdot b_{2_freq}$$

$$r_{norm} = \frac{r}{r_{max}}$$

wherein $f_H$ denotes the higher cut-off frequency, $f_L$ denotes the lower cut-off frequency, $b_{1_freq}$ denotes a first reference cut-off frequency, $b_{2_freq}$ denotes a second reference cut-off frequency, r denotes the first distance, $r_{max}$ denotes a maximum distance, and $r_{norm}$ denotes a normalized distance.

* * * * *